US007214281B2

(12) United States Patent
Gheorghe et al.

(10) Patent No.: US 7,214,281 B2
(45) Date of Patent: May 8, 2007

(54) ALUMINUM-ZINC-MAGNESIUM-COPPER ALLOY EXTRUSION

(75) Inventors: Iulian Gheorghe, Canton, GA (US); Dean C. Malejan, Anaheim, CA (US); Rene Mächler, Eschenbach (CH)

(73) Assignee: Universal Alloy Corporation, Canton, GA (US)

( * ) Notice: Subject to any disclaimer, the term of this patent is extended or adjusted under 35 U.S.C. 154(b) by 36 days.

(21) Appl. No.: 11/083,517

(22) Filed: Mar. 18, 2005

(65) Prior Publication Data

US 2005/0236075 A1 Oct. 27, 2005

Related U.S. Application Data

(63) Continuation-in-part of application No. 10/662,835, filed on Sep. 15, 2003, now abandoned.

(60) Provisional application No. 60/412,200, filed on Sep. 21, 2002.

(51) Int. Cl.
*C22F 1/053* (2006.01)

(52) U.S. Cl. ..... 148/550; 148/690; 148/701

(58) Field of Classification Search ..... 148/550, 148/689, 690, 701, 417
See application file for complete search history.

(56) References Cited

U.S. PATENT DOCUMENTS

| | | | | |
|---|---|---|---|---|
| 1,418,303 A | | 6/1922 | Hall | |
| 2,290,020 A | | 7/1942 | Bonsack | 75/142 |
| 3,563,814 A | | 2/1971 | Lyle, Jr. | 148/12.7 |
| 3,637,441 A | | 1/1972 | Lyle, Jr. et al. | 148/32.5 |
| 4,431,467 A | * | 2/1984 | Staley et al. | 148/701 |
| 4,711,762 A | | 12/1987 | Vernam et al. | 420/532 |
| 4,732,610 A | | 3/1988 | Hildeman et al. | 75/249 |
| 5,028,393 A | | 7/1991 | Tanaka et al. | 420/531 |
| 5,312,498 A | | 5/1994 | Anderson | 148/695 |
| 5,496,426 A | | 3/1996 | Murtha | 148/691 |
| 5,932,037 A | | 8/1999 | Holroyd et al. | 148/689 |
| 6,315,842 B1 | | 11/2001 | Shahani et al. | 148/417 |
| 2002/0121319 A1 | | 9/2002 | Chakrabarti et al. | |

OTHER PUBLICATIONS

"ASM Specialty Handbook: Aluminum and Aluminum Alloys", ASM International, 1993, p. 296.

"ASM Specialty Handbook: Aluminum and Aluminum Alloys", ASM International, 1993, p. 267, 529.

* cited by examiner

*Primary Examiner*—Roy King
*Assistant Examiner*—Janelle Morillo
(74) *Attorney, Agent, or Firm*—Andrew Alexander

(57) ABSTRACT

An aluminum alloy extrusion product having improved strength and fracture toughness, the aluminum base alloy comprised of 1.95 to 2.5 wt. % Cu, 1.9 to 2.5 wt. % Mg, 8.2 to 10 wt. % Zn, 0.05 to 0.25 wt. % Zr, max. 0.15 wt. % Si, max. 0.15 wt. % Fe, max. 0.1 wt. % Mn, the remainder aluminum and incidental elements and impurities.

39 Claims, 1 Drawing Sheet

ALUMINUM-ZINC-MAGNESIUM-COPPER ALLOY EXTRUSION

CROSS REFERENCE TO RELATED APPLICATIONS

This application is a continuation-in-part of U.S. Ser. No. 10/662,835, filed Sep. 15, 2003, now abandoned which claims the benefit of U.S. Provisional Application No. 60/412,200, filed Sep. 21, 2002, incorporated herein by reference.

BACKGROUND OF THE INVENTION

This invention relates to Al—Zn—Mg—Cu alloys and more particularly it relates to Al—Zn—Mg—Cu extrusions and the method of making the same for use in aircraft applications. Further, the invention relates to Al—Zn—Mg—Cu alloy extrusion product having improved fracture toughness.

Existing Al—Zn—Mg—Cu alloys can have relatively high strengths at moderate corrosion resistance and moderate damage tolerance or fracture toughness. Such alloys and methods of obtaining properties are set forth in the patents. For example, U.S. Pat. No. 4,863,528 discloses a method for producing an aluminum alloy product and the resulting product having improved combinations of strength and corrosion resistance. The method includes providing an alloy consisting essentially of about 6–16% zinc, about 1.5–4.5% magnesium, about 1–3% copper, one or more elements selected from zirconium, chromium, manganese, titanium, vanadium and hafnium, the total of said elements not exceeding about 1%, the balance aluminum and incidental impurities. The alloy is then solution heat treated; precipitation hardened to increase its strength to a level exceeding the as-solution heat treated strength level by at least about 30% of the difference between as-solution heat treated strength and peak strength; subjected to treatment at a sufficient temperature or temperatures for improving its corrosion resistance properties; and again precipitation hardened to raise its yield strength and produce a high strength, highly corrosion resistant alloy product.

U.S. Pat. No. 5,221,377 discloses an alloy product having improved combinations of strength, density, toughness and corrosion resistance, said alloy product consisting essentially of about 7.6 to 8.4% zinc, about 1.8 to 2.2% magnesium, about 2 to 2.6% copper and at least one element selected from zirconium, vanadium and hafnium present in a total amount not exceeding about 0.5%, preferably about 0.05 to 0.25% zirconium, the balance aluminum and incidental elements and impurities. The alloy product, suitable for aerospace applications, exhibits high yield strength, at least about 10% greater yield strength than its 7X50-T6 counterpart, with good toughness and corrosion resistance properties typically comparable to or better than those of its 7X50-T76 counterpart. Upper wing members made from this alloy typically have a yield strength over 84 ksi, good fracture toughness and an EXCO exfoliation resistance level of "EC" or better, typically "EB".

U.S. Pat. No. 4,477,292 discloses a three-step thermal aging method for improving the strength and corrosion resistance of an article comprising a solution heat treated aluminum alloy containing zinc, magnesium, copper and at least one element selected from the group consisting of chromium, manganese and zirconium. The article is precipitation hardened at about 175° to 325° F., heat treated for from several minutes to a few hours at a temperature of about 360° to 390° F. and again precipitation hardened at about 175° to 325° F. In a preferred embodiment the article treated comprises aluminum alloy 7075 in the T6 condition. The method of the invention is easier to control and is suitable for treating articles of greater thickness than other comparable methods.

U.S. Pat. No. 5,108,520 discloses an aging process for solution-heat-treated, precipitation hardening metal alloy which includes first underaging the alloy, such that a yield strength below peak yield strength is obtained, followed by higher aging for improving the corrosion resistance of the alloy, followed by lower temperature aging to strength increased over that achieved initially.

U.S. Pat. No. 5,560,789 discloses AA 7000 series alloys having high mechanical strength and a process for obtaining them. The alloys contain, by weight, 7 to 13.5% Zn, 1 to 3.8% Mg, 0.6 to 2.7% Cu, 0 to 0.5% Mn, 0 to 0.4% Cr, 0 to 0.2% Zr, others up to 0.05% each and 0.15% total, and remainder Al. Either wrought or cast alloys can be obtained, and the specific energy associated with the DEA melting signal of the product is lower than 3 J/g.

U.S. Pat. No. 5,312,498 discloses a method of producing an aluminum-based alloy product having improved exfoliation resistance and fracture toughness which comprises providing an aluminum-based alloy composition consisting essentially of about 5.5–10.0% by weight of zinc, about 1.75–2.6% by weight of magnesium, about 1.8–2.75% by weight of copper with the balance aluminum and other elements. The aluminum-based alloy is worked, heat treated, quenched and aged to produce a product having improved corrosion resistance and mechanical properties. The amounts of zinc, magnesium and copper are stoichiometrically balanced such that after precipitation is essentially complete as a result of the aging process, no excess elements are present. The method of producing the aluminum-based alloy product utilizes either a one- or two-step aging process in conjunction with the stoichiometrically balancing of copper, magnesium and zinc.

U.S. Pat. No. 4,711,762 discloses an improved aluminum base alloy product comprising 0 to 3.0 wt. % Cu, 0 to 1.5 wt. % Mn, 0.1 to 4.0 wt. % Mg, 0.8 to 8.5 wt. % Zn, at least 0.005 wt. % Sr, max. 1.0 wt. % Si, max. 0.8 wt. % Fe and max. 0.45 wt. % Cr, 0 to 0.2 wt. % Zr, the remainder aluminum and incidental elements and impurities.

U.S. Pat. No. 1,418,303 discloses an improved aluminum alloy consisting of copper about 0.1% to any amount below 3%, titanium about 0.1% to about 2%, zinc about 6% to about 16%, iron (present as an impurity of commercial aluminum) preferably not exceeding 0.6%, silicon (present as an impurity of commercial aluminum) preferably not exceeding 0.4%, other elements (impurities) preferably not exceeding 0.4%, remainder aluminum.

U.S. Pat. No. 2,290,020 discloses an improved aluminum alloy having the ternary compound of aluminum, zinc and magnesium present in an amount ranging from about 2% to 20%, the preferred range being between about 3% and 15%. At room temperature the ternary compound goes into solid solution in aluminum alloys in an amount of about 2%. The percentage in solid solution increases at high temperatures and decreases upon cooling, the excess precipitating out.

U.S. Pat. No. 3,637,441 discloses an aluminum base powder metallurgy alloy article having an improved combination of high-transverse yield strength and high-stress corrosion cracking resistance. The alloy contains the basic precipitation hardening elements zinc, magnesium and copper plus dispersion strengthening elements iron and nickel. It may additionally contain chromium and/or manganese.

The alloy is prepared by atomization of a melt of the elements, hot-working, solution heat treating, quenching and artificial aging. Components of the alloy in percent by weight are, in addition to the aluminum, from at least 6.5 to 13 zinc, 1.75 to 6 magnesium, 0.25 to 2.5 copper, 0.75 to 4.25 iron and 0.75 to 6 nickel, up to 3 manganese and up to 0.75 chromium. The iron to nickel ratio is from 0.2:1 to 2.0:1.

U.S. Pat. No. 5,028,393 discloses an Al-based alloy for use as sliding material, superior in fatigue resistance and anti-seizure property consisting, by weight, of 1–10% Zn, 1–15% Si, 0.1–5% Cu, 0.1–5% Pb, 0.005–0.5% Sr, and the balance Al and incidental impurities.

U.S. Pat. No. 6,315,842 discloses a mold for plastics made of a rolled, extruded or forged AlZnMgCu aluminum alloy product >60 mm thick, and having a composition including, in weight %: 5.7<Zn<8.7, 1.7<Mg<2.5, 1.2<Cu<2.2, Fe<0.14, Si<0.11, 0.05<Zr<0.15, Mn<0.02, Cr<0.02, with Cu+Mg<4.1 and Mg>Cu, other elements <0.05 each and <0.10 in total, the product being treated by solution heat treating, quenching and aging to a T6 temper.

In spite of these discloses, there is still a great need for an improved alloy and extrusion fabricated therefrom for aerospace applications having high levels of strength, corrosion resistance, fracture toughness and good resistance to fatigue crack growth. The subject invention provides such an extrusion.

SUMMARY OF THE INVENTION

It is an object of the invention to provide an improved Al—Zn—Mg—Cu alloy extrusion for use in aircrafts.

It is another object of the invention to provide an Al—Zn—Mg—Cu alloy extrusion having improved fracture toughness as well as having high strength levels.

It is yet another object of the invention to provide a method for producing an Al—Zn—Mg—Cu alloy extrusion having improved strength properties, fracture toughness and resistance to fatigue crack growth.

It is still another object of the invention to provide a method for producing an Al—Zn—Mg—Cu alloy product having improved strength properties, fracture toughness, good levels of corrosion resistance.

It is another object of this invention to provide aerospace structural members such as extrusions from the alloy of the invention.

In accordance with these objects, there is provided a method of producing an aluminum alloy extrusion product having improved fracture toughness, the method comprising the steps of providing a molten body of an aluminum base alloy comprised of 1.95 to 2.5 wt. % Cu, 1.9 to 2.5 wt. % Mg, 8.2 to 10 wt. % Zn, 0.05 to 0.25 wt. % Zr, max.

0.15 wt. % Si, max. 0.15 wt. % Fe, max. 0.1 wt. % Mn, the remainder aluminum and incidental elements and impurities; and casting the molten body of the aluminum base alloy to provide a solidified body, the molten aluminum base alloy being solidified at a rate between liquidus and solidus temperatures in the range of 600° to 800° K. per second to provide a solidified body having a grain size in the range of 25 to 75 μm. Thereafter, the body is homogenized by heating in a first temperature range of 840° to 860° F. followed by heating in a second temperature range of 680° to 880° F. wherein the second temperature is higher than the first to provide a homogenized body having a uniform distribution of $MgZn_2$ or η precipitate. The homogenized body is then extruded to provide an extrusion, the extruding being carried out in a temperature range of 600° to 850° F. and at a rate sufficient to maintain at least 80% of said extrusion in a non-recrystallized condition. The extrusion is solution heat treated and artificial aged to improve strength properties and to provide an extrusion product having improved fracture toughness.

The improved aluminum base alloy extrusion product can have a yield strength to fracture toughness ratio of 8% or greater than a similarly sized 7xxx product.

The invention also includes an improved aluminum base alloy wrought product such as an extrusion product consisting essentially of 1.95 to 2.5 wt. % Cu, 1.95 to 2.5 wt. % Mg, 8.2 to 10 wt. % Zn, 0.05 to 0.25 wt. % Zr, 0.05 to 0.2 wt. % Sc, max. 0.15 wt. % Si, max. 0.15 wt. % Fe, max. 0.1 wt. % Mn, the remainder aluminum and incidental elements and impurities.

DETAILED DESCRIPTION OF THE PREFERRED EMBODIMENTS

Figure 1:
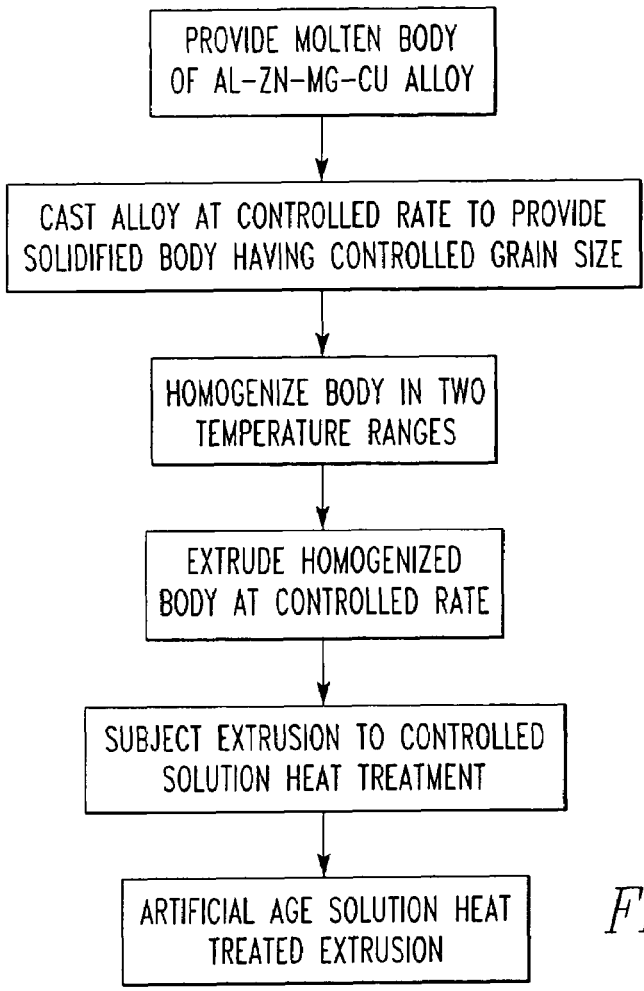
FIG. 1 is a flow chart showing steps of the invention.

Referring to FIG. 1, there is shown a flow chart of steps in the invention. Generally, in the steps a molten body of Al—Zn—Mg—Cu alloy is cast at a controlled solidification rate to obtain a specific grain size range in the cast body. Thereafter, the cast body is homogenized under controlled conditions to obtain a uniform distribution of $MgZn_2$ or η precipitate. The body is extruded in a specific rate range and temperature to obtain an extrusion having a large portion thereof, e.g., at least 80%, in a non-recrystallized condition. The extrusion is then solution heat treated and aged to very high levels of strength, fracture toughness and corrosion resistance.

The alloy of the invention contains about 8.2 to 10 wt. % Zn, 1.95 to 2.5 wt. % Mg, 1.95 to 2.5 wt. % Cu, 0.05 to 0.25 wt. % Zr, max. 0.15 wt. % Si, max. 0.15 wt. % Fe, max. 0.1 wt. % Mn, the remainder aluminum, incidental elements and impurities.

Preferably, the alloy contains 1.95 to 2.3 wt. % Cu, 1.95 to 2.3 wt. % Mg, 8.45 to 9.4 wt. % Zn, 0.05 to 0.2 wt. % Cr and 0.05 to 0.15 wt. % Zr. Cr can range from 0.05 to 0.08 wt. %. For purposes of retarding recrystallization, the alloys can contain 0.01 to 0.2 wt. % Sc, preferably 0.01 to 0.1 wt. %. Such alloys when processed in accordance with the invention possess marked improvements in yield strength to fracture toughness ratio at acceptable or even high levels of strength and corrosion resistance compared to conventional 7xxx alloys such as AA7075-T6, for example. The composition of the AA 7xxx alloys are set forth in The Aluminum Association publication entitled "Registration Record of Aluminum Association Designations and Chemical Composition Limits for Wrought Aluminum and Wrought Aluminum Alloys", dated December 1993. The term "7xxx" means aluminum alloys containing zinc as a main alloying ingredient. AA 7075-T6 refers to AA compositional limits as registered with The Aluminum Association. A typical T6 aging practice for 7075 is heating at about 250° F. for 24 hours and a typical temperature range is about 175° to 330° F. for 3 to 30 hours.

For purposes of the present invention, a molten aluminum alloy of the invention is cast into a solidified body at a rate which provides a controlled microstructure or grain size.

Such molten aluminum alloy typically is cast in the form of billet when it is desired to produce extrusion products. Further, typically such solidified body is cast at a rate of about 1 to 6 inches per minute, preferably 2 to 4 inches per minute, and typically the billet has a diameter in the range of about 1 to 7 inches. For purposes of the invention, it is preferred that the solidified body has an average grain size in the range of 25 to 100 μm, preferably 35 to 75 μm. If the alloy of the invention is cast at controlled rates and thermally mechanically processed in accordance with the invention, very high tensile and compressive strengths, fracture toughness and corrosion resistance can be obtained. That is, for purposes of obtaining the desired microstructure for thermal mechanical processing in accordance with the invention, the molten aluminum is cast at a controlled solidification rate. It has been discovered that controlled solidification rate of the disclosed aluminum alloy in combination with subsequent controlled thermal mechanical processing results in extruded products having superior properties, i.e., very high tensile strength, good corrosion and dent resistance.

It should be noted that the strength of the subject aluminum alloys can be improved by dispersion hardening or by strain hardening. Strain hardening is the result of plastic deformation and is dependent on the degree of deformation. Dispersion hardening is produced through formation of clusters of atoms (referred to as Guiner-Preston or GP zones). In addition, precipitation hardening can result from the formation of new phases or precipitates in the alloy which form barriers against dislocation movement. This can significantly increase the strength of the alloy. In the Al—Zn—Mg—Cu alloys, new strengthening phases include $MgZn_2$, also known as M or η-phase; $Mg_3Zn_3Al_2$ also as the T-phase; $CuMgAl_2$ also known as the S-phase. Strengthening resulting from precipitation of new phases is more effective than strengthening by formation of GP zones. However, strengthening by precipitation of new phases can have an adverse effect on damage tolerance or fracture toughness. Usually, the greater the volume fraction in the precipitation phases, the lower is the damage tolerance. By comparison, strengthening resulting from GP zone formation does not take place at the expense of damage tolerance. Thus, to provide for improved strength and damage tolerance, the present invention balances the volume fraction of precipitates and the volume fraction of GP zones or zinc-rich clusters in the final product while maintaining excess zinc in solution. For the purpose of the invention the GP zones size should be in the range of 2 to 35 nm and the GP zones density should be in the range of $4\times10^{18}$ to $5\times10^{18}$ zones per $cm^3$.

For purposes of producing billet in accordance with the invention, casting may be accomplished using a mold cooled by an air and liquid coolant to solidify billet at a controlled rate which provides the desired grain size or structure. The grain can have a size in the range of 35 to 75 μm. The air and coolant mixture used with the molds are particularly suited for extracting heat from the body of molten aluminum alloy to obtain a solidification rate of 5° to 50° C. per second for billet having a diameter of 1 to 6 inches. Molds using the air and coolant mixture which are suitable for controlling the cooling rate for casting molten aluminum alloy of the invention are described in U.S. Pat. No. 4,598,763. The coolant for use with these molds for the invention is comprised of a gas and a liquid where gas is infused into the liquid as tiny, discrete undissolved bubbles and the combination is directed on the surface of the emerging ingot. The bubble-entrained coolant operates to cool the metal at an increased rate of heat extraction; and if desired, the increased rate of extraction, together with the discharge rate of the coolant, can be used to control the rate of cooling at any stage in the casting operation, including during the steady state casting stage.

For casting metal, e.g., aluminum alloy to provide a microstructure suitable for purposes of the present invention, molten metal is introduced to the cavity of an annular mold, through one end opening thereof, and while the metal undergoes partial solidification in the mold to form a body of the same on a support adjacent the other end opening of the cavity, the mold and support are reciprocated in relation to one another endwise of the cavity to elongate the body of metal through the latter opening of the cavity. Liquid coolant is introduced to an annular flow passage which is circumposed about the cavity in the body of the mold and opens into the ambient atmosphere of the mold adjacent the aforesaid opposite end opening thereof to discharge the coolant as a curtain of the same that impinges on the emerging body of metal for direct cooling. Meanwhile, a gas which is substantially insoluble in the coolant liquid is charged under pressure into an annular distribution chamber which is disposed about the passage in the body of the mold and opens into the passage through an annular slot disposed upstream from the discharge opening of the passage at the periphery of the coolant flow therein. The body of gas in the chamber is released into the passage through the slot and is subdivided into a multiplicity of gas jets as the gas discharges through the slot. The jets are released into the coolant flow at a temperature and pressure at which the gas is entrained in the flow as a mass of bubbles that tend to remain discrete and undissolved in the coolant as the curtain of the same discharges through the opening of the passage and impinges on the emerging body of metal. With the mass of bubbles entrained therein, the curtain has an increased velocity, and this increase can be used to regulate the cooling rate of the coolant liquid, since it more than offsets any reduction in the thermal conductivity of the coolant. In fact, the high velocity bubble-entrained curtain of coolant appears to have a scrubbing effect on the metal, which breaks up any film and reduces the tendency for film boiling to occur at the surface of the metal, thus allowing the process to operate at the more desirable level of nucleate boiling, if desired. The addition of the bubbles also produces more coolant vapor in the curtain of coolant, and the added vapor tends to rise up into the gap normally formed between the body of metal and the wall of the mold immediately above the curtain to cool the metal at that level. As a result, the metal tends to solidify further up the wall than otherwise expected, not only as a result of the higher cooling rate achieved in the manner described above, but also as a result of the build-up of coolant vapor in the gap. The higher level assures that the metal will solidify on the wall of the mold at a level where lubricating oil is present; and together, all of these effects produce a superior, more satin-like, drag-free surface on the body of the metal over the entire length of the ingot and is particularly suited to thermal transformation.

When the coolant is employed in conjunction with the apparatus and technique described in U.S. Pat. No. 4,598,763, this casting method has the further advantage that any gas and/or vapor released into the gap from the curtain intermixes with the annulus of fluid discharged from the cavity of the mold and produces a more steady flow of the latter discharge, rather than the discharge occurring as intermittent pulses of fluid.

As indicated, the gas should have a low solubility in the liquid; and where the liquid is water, the gas may be air for cheapness and ready availability.

During the casting operation, the body of gas in the distribution chamber may be released into the coolant flow passage through the slot during both the butt forming stage and the steady state casting stage. Or, the body of gas may be released into the passage through the slot only during the steady state casting stage. For example, during the butt-forming stage, the coolant discharge rate may be adjusted to undercool the ingot by generating a film boiling effect; and the body of gas may be released into the passage through the slot when the temperature of the metal reaches a level at which the cooling rate requires increasing to maintain a desired surface temperature on the metal. Then, when the surface temperature falls below the foregoing level, the body of gas may no longer be released through the slot into the passage, so as to undercool the metal once again. Ultimately, when steady state casting is begun, the body of gas may be released into the passage once again, through the slot and on an indefinite basis until the casting operation is completed. In the alternative, the coolant discharge rate may be adjusted during the butt-forming stage to maintain the temperature of the metal within a prescribed range, and the body of gas may not be released into the passage through the slot until the coolant discharge rate is increased and the steady state casting stage is begun.

The coolant, molds and casting method are further set forth in U.S. Pat. Nos. 4,598,763 and 4,693,298, incorporated herein by reference.

While the casting procedure for the present invention has been described in detail for producing billet having the necessary structure for thermal transformation in accordance with the present invention, it should be understood that the other casting methods can be used to provide the solidification rates that result in the grain structure necessary to the invention. As noted earlier, such solidification can be obtained by belt, block or roll casting and electromagnetic casting.

A seven inch billet of an alloy containing 8.9 wt. % Zn, 2.1 wt. % Mg, 2.1 wt. % Cu, 0.11 wt. % Zr, the remainder comprising aluminum, cast employing a mold using air and water coolant, at a cooling rate of 35° to 50° F. per second provides a satisfactory grain structure for extruding and thermally mechanically processing in accordance with the invention.

While casting has been described with respect to billet, it will be appreciated that the principles described herein may be applied to ingot or electromagnetic casting of the aluminum alloys.

After the billet is cast, it is subjected to a homogenization treatment. Preferably, the billet is subjected to two homogenization treatments. In the first homogenization treatment, the billet preferably is treated in a temperature range of 840° to 860° F. for a period of 6 to 18 hours. Thereafter, the billet is then preferably subjected to a temperature range of 860° to 880° F. for a period of 4 to 36 hours. In the second step, the temperature is higher than the temperature used in the first step. Subjecting the billet to a double homogenization treatment as described provides a billet with a more uniform distribution of $MgZn_2$ precipitate or M or η-phase as well as zinc and chromium containing dispersoids.

After homogenization, the billet is extruded to provide an extrusion member. For purposes of extruding, the billet is heated to a temperature range of 600° to 850° F. and maintained in this temperature range during extruding. Preferably, the billet is extruded at a rate in the range of 0.8 to 8 ft/min and preferably at an extrusion ratio in the range of 10 to 60. These conditions are important to obtain an extrusion wherein at least 80% and preferably 90% of the extrusion is maintained in the unrecrystallized condition. The extrusion can have an aspect ratio between the thinnest and thickest section of 1:4 to 1:18.

After extruding, the product is solution heat treated by heating in a temperature range of about 870° F. to about 890° F., with a preferred temperature range being 875° to 885° F. Typical times at these temperatures can range from 5 to 120 minutes. The solution heat treating should be carried out for a time sufficient to dissolve a substantial portion of the alloying elements. That is, substantially all of the zinc, magnesium and copper is dissolved to provide a solid solution.

After solution heat treating, the extrusion is rapidly cooled or quenched by immersion or spraying with cold water, for example. After quenching, the extrusion may be straightened and/or stretched. That is, the extrusion is straightened prior to aging to improve strength properties.

After solution heat treating, the extrusion is treated to improve properties such as strength, corrosion and fracture toughness.

Thus, the extrusion may be subject to different thermal treatments depending on the properties desired. For example, the extrusion may be subject to a single step thermal treatment to achieve high or peak strength, referred to as T6 type tempers. However, such tempers can be susceptible to stress corrosion cracking. T6 tempers are obtained by aging at a temperature range of 175° to 325° F. for 3 to 30 hours. A two step aging process may be employed wherein a first aging step is carried out at 175° to 300° F. for a period of time of 3 to 30 hours, followed by a second aging step carried out at 300° to 360° F. for a period of time of 3 to 24 hours. This aging process produces an overaged temper referred as T7x temper. This condition improves stress corrosion cracking but can decrease strength.

To improve strength and corrosion resistance, the extrusion may be subject to a three-step aging process. The aging steps or phases include a low-high-low aging sequence. In the first or low aging step, the extrusion is subject to a temperature for a period of time which precipitation hardens the extrusion to a point at or near peak strength. This can be effected by subjecting the extrusion to precipitation hardening in a temperature range of about 150° to 325° F. typically for a time between 2 to 30 hours. Then, the extrusion is subject to a second treatment to improve corrosion resistance. The second treatment includes subjecting the extrusion to a temperature range of 300° to 500° F. for 5 minutes to about 3 hours, for example. In the third step, the extrusion is subject to another strengthening step. The third thermal treatment includes subjecting the extrusion to a temperature of 175° to 325° F. for about 2 to 30 hours.

Exfoliation corrosion (EXCO) behavior of the inventive alloy was compared to 7075 T6511 and 7075 T76511 alloys. The American Society for Testing and Materials developed a method (ASTM G34–99) that provides an accelerated exfoliation corrosion test for 2xxx and 7xxx series aluminum alloys. The susceptibility to exfoliation is determined by visual examination, with performance ratings established by reference to standard photographs. When tested in accordance with this test method the alloy of the invention exhibits a typical EA exfoliation corrosion rating when aged to a T76 temper. When aged to a T77 temper the invention alloy exhibits a typical EB exfoliation corrosion rating.

While alloy has been described with respect to extrusion products, it can find use as sheet and plate product and such is contemplated herein.

All ranges set forth herein include all the numbers within the range as if specifically set forth.

The products or members described herein in accordance with the invention are particularly suitable for aerospace applications and finds many uses in large aircrafts such as commercial and military aircrafts. The products can be used in wing components, tail assemblies, fuselage sections or in subassemblies or other components comprising the aircraft. That is, the aircraft assemblies can comprise a wing assembly or wing subassembly, a center wing box assembly or subassembly, floor assembly or subassembly including seat tracks, floor beams, stanchions, cargo deck assemblies and subassemblies, floor panels, cargo floor panels, fuselage assemblies or subassemblies, fuselage frames, wing ribs, fuselage stringers and the like. Further, the products may be produced as seamless or non-seamless tubes and used in sporting goods such as baseball bats.

TABLE

Typical mechanical properties of the inventive alloy (M703) in comparison to 7075 T6511 and 7150 T77511 for extrusions 0.249 inch thick

| Alloy | Temper | UTS, ksi | YS, ksi | e, % | $K_{Ic}$ |
|---|---|---|---|---|---|
| 7075 | T6511 | 88 | 82 | 10 | 28 |
| M703 | T76511 | 97 | 93 | 10 | 33 |
| M703 | T77511 | 102 | 100 | 9 | 32.5 |
| 7150 | T77511 | 93 | 89 | 9 | 27 |

The table illustrates the mechanical properties of the inventive alloy when aged to a T76 and a T77 tempers.

The following examples are still further illustrative of the invention.

EXAMPLE 1

A billet of an alloy containing 8.9 wt. % Zn, 2.1 wt. % Mg, 2.1 wt. % Cu, 0.11 wt. % Zr, incidental elements and impurities, the balance aluminum, was cast into a seven inch diameter billet. The billet was cast using casting molds utilizing air and liquid coolant (available from Wagstaff Engineering, Inc., Spokane, Wash.). The air/water coolant was adjusted in order that the body of molten aluminum alloy was cast at a rate of 4 inches per minute. The as-cast structure had an average grain size of 35 μm. The billet was homogenized for 8 hours at 870° F. and then for 24 hours at 885° F. Thereafter, the billet was brought to a temperature of 725° F. and extruded into a hollow tube with an outside diameter of 2.65 inch and a wall thickness of 0.080 inch.

The extrusion had a non-recrystallized grain structure. The extrusion was solution heat treated for 25 minutes at 880° F. and quenched in a water-15% glycol solution. Thereafter, the quenched extrusion was precipitation hardened for 24 hours at 250° F. and then subjected to a temperature of 315° F. for 6 hours to improve corrosion resistance and yield strength properties. The extrusion was then tested for tensile strength and yield strength and compared to AA 7075 T6. The results are reproduced in Table 1.

Figure 2:
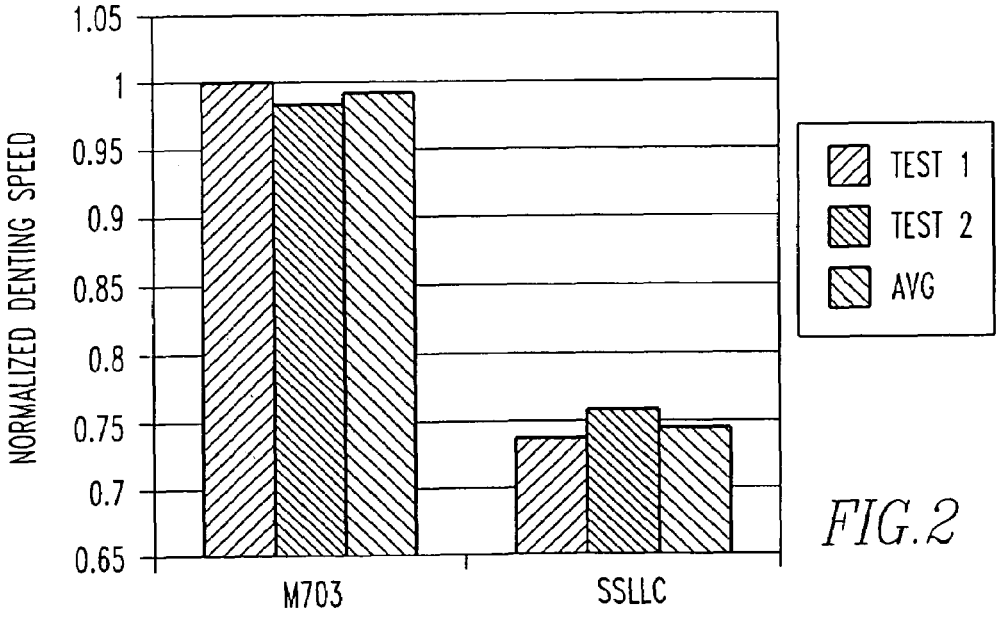
FIG. 2 illustrates the results of the damage tolerance (normalized denting speed) of the invention alloy (M703) compared to a high strength 7xxx alloys (SSLLC).

The extrusion was then tested for dent resistance or damage tolerance. The dent resistance test was performed by pitching balls of constant size and weight at the extruded tube. The number of pitches to the first dent on the extrude tube represents the dent resistance. The extrusion was compared to a AA 7055 alloy treated in a similar fashion. The alloy of the invention is referred to as M703 and 7055 as SSLLC (see FIG. 2). Both alloys were aged identically. It will be seen from FIG. 2 that M703 had superior dent resistance.

EXAMPLE 2

A billet of an alloy containing 8.9 wt. % Zn, 2.1 wt. % Mg, 2.1 wt. % Cu, 0.11 wt. % Zr, incidental elements and impurities, the balance aluminum, was cast into a seven inch diameter billet. The billet was cast using casting molds utilizing air and liquid coolant (available from Wagstaff Engineering, Inc., Spokane, Wash.). The air/water coolant was adjusted in order that the body of molten aluminum alloy was cast at a rate of 4 inches per minute. The as-cast structure had an average grain size of 35 μm. The billet was homogenized for 8 hours at 870° F. and then for 24 hours at 885° F. Thereafter, the billet was brought to a temperature of 725° F. and extruded into an aircraft stringer having a "T" shaped cross section and a wall thickness of 0.245 inches.

The extrusion had a non-recrystallized grain structure. The extrusion was solution heat treated for 35 minutes at 880° F. and quenched in a water-15% glycol solution. Thereafter, the quenched extrusion was precipitation hardened for 24 hours at 250° F. followed by 25 to 35 minutes at 380° F., then subjected to a temperature of 250° F. for 24 hours. The extrusion was then tested for tensile strength and yield strength and fracture toughness, fatigue crack growth and compared to AA 7075 T6511 and AA 7150 T77511. The results are reproduced in Table 1. It will be seen that the inventive alloy has superior strength and fracture toughness when compared to AA 7075 T6511 and AA 7150 T77511. Also, the extrusion has a unique combination of tensile strength, corrosion resistance, and damage tolerance (i.e., fracture toughness and fatigue crack growth).

Having described the presently preferred embodiments, it is to be understood that the invention may be otherwise embodied within the scope of the appended claims.

What is claimed is:

1. A method of producing an aluminum alloy extrusion product having improved fracture toughness, the method comprising the steps of:

(a) providing a molten body of an aluminum base alloy comprised of 1.95 to 2.5 wt. % Cu, 1.95 to 2.5 wt. % Mg, 8.2 to 10 wt. % Zn, 0.05 to 0.25 wt. % Zr, max. 0.15 wt. % Si, max. 0.15 wt. % Fe, max. 0.1 wt. % Mn, the remainder aluminum and incidental elements and impurities;

(b) casting said molten body of said aluminum base alloy to provide a solidified body, said molten aluminum base alloy being cast at a rate in the range of 1 to 6 inches per minute;

(c) homogenizing said body by heating in a first temperature range of 840 to 860° F. followed by heating in a second temperature range of 860° to 880° F., the second homogenization temperature being greater than the first temperature to provide a homogenized body having a uniform distribution of η precipitate and zirconium containing dispersoids;

(d) extruding said homogenized body to provide an extrusion, said extruding being carried out in a temperature range of 600° to 850° F. and at a rate sufficient to maintain at least 80% of the cross-sectional area of said extrusion in a non-recrystallized condition;

(e) solution heat treating said extrusion; and (f) artificial aging said product to improve strength properties to provide an extrusion product having improved yield strength to fracture toughness ratio.

2. The method in accordance with claim 1 wherein the alloy contains 1.95 to 2.3 wt. % Cu.

3. The method in accordance with claim 1 wherein the alloy contains 1.9 to 2.3 wt. % Mg.

4. The method in accordance with claim 1 wherein the alloy contains 0.05 to 0.2 wt. % Cr.

5. The method in accordance with claim 1 wherein the alloy contains 8.45 to 9.4 wt. % Zn.

6. The method in accordance with claim 1 wherein the alloy contains 0.01 to 0.1 wt. % Sc.

7. The method in accordance with claim 1 wherein the alloy contains 0.01 to 0.2 wt. % Ti.

8. The method in accordance with claim 1 including heating in said first temperature range for 6 to 18 hours.

9. The method in accordance with claim 1 including heating in said second temperature range for 4 to 36 hours.

10. The method in accordance with claim 1 including rapidly quenching said extrusion.

11. The method in accordance with claim 1 wherein said extruding is carried out at a rate in the range of 0.5 to 8 ft/min.

12. The method in accordance with claim 1 wherein said solution heat treating is carried out in a temperature range of 875° to 885° F. for 5 to 120 minutes.

13. The method in accordance with claim 1 wherein said artificial aging is carried out by aging in a temperature range of 175° to 300° F. for 3 to 30 hours followed by aging at 280° to 360° F. for 3 to 24 hours.

14. The method in accordance with claim 1 wherein said artificial aging is carried out by aging in a temperature range of 210° to 280° F. for 4 to 24 hours followed by aging at 320° to 400° F. for 30 minutes to 14 hours.

15. The method in accordance with claim 1 wherein said artificial aging is carried out by aging in a temperature range of 150° to 325° F. for 2 to 30 hours followed by aging at 300° to 500° F. for 5 minutes to 3 hours followed by aging at 175° to 325° F. for 2 to 30 hours.

16. The method in accordance with claim 1 wherein said artificial aging is a three-step process wherein said first and third steps improve strength and a second step improves corrosion resistance.

17. The method in accordance with claim 1 wherein said artificial aging includes aging: (i) at a low temperature above room temperature to precipitation harden said extrusion; (ii) at temperatures to improve corrosion resistance properties of said extrusion; and (iii) at lower temperatures above room temperature to precipitation harden said extrusion.

18. The method in accordance with claim 1 wherein the extrusion has a fracture toughness at least 5% greater than a similar extrusion fabricated from 7075 alloy.

19. The method in accordance with claim 1 wherein the extrusion has a tensile strength to fracture toughness ratio at least 8% greater than a similar extrusion fabricated from 7075 alloy.

20. A method of producing an aluminum alloy extrusion product having improved strength and fracture toughness, the method comprising the steps of:

(a) providing a molten body of an aluminum base alloy comprised of 1.95 to 2.3 wt. % Cu, 1.95 to 2.3 wt. % Mg, 8.2 to 9.4 wt. % Zn, 0.05 to 0.2 wt. % Cr, 0.05 to 0.15 wt. % Zr, max. 0.15 wt. % Si, max. 0.15 wt. % Fe, max. 0.1 wt. % Mn, the remainder aluminum and incidental elements and impurities;

(b) casting said molten body of said aluminum base alloy to provide a solidified body, said molten aluminum base alloy being cast at a rate in the range of 1 to 6 inches per minute;

(c) homogenizing said body by heating in a first temperature range of 840° to 860° F. for 6 to 24 hours followed by heating in a second temperature range of 860° to 880° F. for 4 to 36 hours wherein the second homogenization temperature is greater than the first temperature to provide a homogenized body having a uniform distribution of η precipitate and zirconium and chromium containing dispersoids;

(d) extruding said homogenized body to provide an extrusion, said extruding being carried out in a temperature range of 600° to 850° F. and at a rate in the range of 0.5 to 8.0 ft/min to provide an extrusion with the non-recrystallized area representing at least 80% of the cross sectional area of the extrusion;

(e) rapidly quenching said extrusion;

(f) solution heat treating said extrusion; and (g) artificial aging said product to improve strength properties to provide an extrusion product having improved fracture toughness.

21. The method in accordance with claim 20 wherein the alloy contains 0.01 to 0.1 wt. % Sc.

22. The method in accordance with claim 20 wherein the alloy contains 0.01 to 0.2 wt. % Ti.

23. The method in accordance with claim 20 wherein said solution heat treating is carried out in a temperature range of 875° to 885° F. for 5 to 120 minutes.

24. The method in accordance with claim 20 wherein said artificial aging is carried out by aging in a temperature range of 175° to 300° F. for 3 to 30 hours followed by aging at 280° to 360° F. for 3 to 24 hours.

25. The method in accordance with claim 20 wherein said artificial aging is carried out by aging in a temperature range of 245° to 255° F. for 6 to 24 hours followed by aging at 360° to 390° F. for 5 to 120 minutes.

26. The method in accordance with claim 20 wherein said artificial aging is a three-step process wherein said first and third steps improve strength and a second step improves corrosion resistance.

27. The method in accordance with claim 20 wherein said artificial aging includes aging: (i) at a low temperature above room temperature to precipitation harden said extrusion; (ii) at temperatures to improve corrosion resistance properties of said extrusion; and (iii) at lower temperatures above room temperature to precipitation harden said extrusion.

28. The method in accordance with claim 20 wherein the extrusion has a fracture toughness at least 5% greater than a similar extrusion fabricated from 7075 alloy.

29. The method in accordance with claim 20 wherein said artificial aging is carried out by aging in a temperature range of 150° to 325° F. for 2 to 30 hours followed by aging at 300° to 500° F. for 5 minutes to 3 hours followed by aging at 175° to 325° F. for 2 to 30 hours.

30. A method of producing an aluminum alloy extrusion product having improved strength and fracture toughness, the method comprising the steps of:

(a) providing a molten body of an aluminum base alloy comprised of 1.95 to 2.5 wt. % Cu, 1.9 to 2.5 wt. % Mg, 8.2 to 10 wt. % Zn, 0.05 to 0.25 wt. % Zr, max. 0.15 wt. % Si, max. 0.15 wt. % Fe, max. 0.1 wt. % Mn, the remainder aluminum and incidental elements and impurities;

(b) casting said molten body of said aluminum base alloy to provide a solidified body, said molten aluminum base alloy being cast at a rate in the range of 1 to 4 inches per minute;

(c) homogenizing said body by heating in a first temperature range of 840 to 860° F. followed by heating in a second temperature range of 860° to 880° F., the second homogenization temperature being greater than the first temperature to provide a homogenized body having a uniform distribution of η precipitate;

(d) extruding said homogenized body to provide an extrusion, said extruding being carried out in a temperature range of 600° to 850° F. at an extrusion ratio in the range of 10 to 60 and an extrusion rate in the range of 0.5 to 8.0 ft/min to provide said extrusion in a substantially non-recrystallized condition;

(e) rapidly quenching said extrusion;

(f) solution heat treating said extrusion; and (g) artificial aging said product to improve strength properties to provide an extrusion product having improved fracture toughness.

31. The method in accordance with claim 30 wherein the alloy contains 0.05 to 0.2 wt. % Cr.

32. The method in accordance with claim 30 wherein the alloy contains 0.01 to 0.2 wt. % Ti.

33. The method in accordance with claim 30 wherein the alloy contains 0.01 to 0.2 wt. % Sc.

34. The method in accordance with claim 30 wherein said solution heat treating is carried out in a temperature range of 875° to 885° F. for 5 to 120 minutes.

35. The method in accordance with claim 30 wherein said artificial aging is carried out by aging in a temperature range of 175° to 300° F. for 3 to 30 hours followed by aging at 280° to 360° F. for 3 to 24 hours.

36. The method in accordance with claim 30 wherein said artificial aging is carried out by aging in a temperature range of 210° to 280° F. for 4 to 24 hours followed by aging at 300° to 400° F. for 1 to 14 hours.

37. The method in accordance with claim 30 wherein said artificial aging includes aging: (i) at a low temperature above room temperature to precipitation harden said extrusion; (ii) at temperatures to improve corrosion resistance properties of said extrusion; and (iii) at lower temperatures above room temperature to precipitation harden said extrusion.

38. The method in accordance with claim 30 wherein said artificial aging is carried out by aging in a temperature range of 150° to 325° F. for 2 to 30 hours followed by aging at 300° to 500° F. for 5 minutes to 3 hours followed by aging at 175° to 325° F. for 2 to 30 hours.

39. A method of producing an aluminum alloy extrusion product having improved yield strength to fracture toughness ratio, the method comprising the steps of:

(a) providing a molten body of an aluminum base alloy comprised of 1.95 to 2.5 wt. % Cu, 1.95 to 2.5 wt. % Mg, 8.45 to 9.4 wt. % Zn, 0.05 to 0.25 wt. % Zr, max. 0.15 wt. % Si, max. 0.15 wt. % Fe, max. 0.1 wt. % Mn, the remainder aluminum and incidental elements and impurities;

(b) casting said molten body of said aluminum base alloy to provide a solidified body, said molten aluminum base alloy being cast at a rate in the range of 1 to 6 inches per minute;

(c) homogenizing said body by heating in a first temperature range of 840 to 860° F. followed by heating in a second temperature range of 860° to 880° F. to provide a homogenized body having a uniform distribution of η precipitate and zirconium containing dispersoids;

(d) extruding said homogenized body to provide an extrusion, said extruding being carried out in a temperature range of 600° to 850° F. and at a rate sufficient to maintain at least 80% of the cross-sectional area of said extrusion in a non-recrystallized condition;

(e) solution heat treating said extrusion; and (f) artificial aging said product to improve strength properties to provide an extrusion product having improved yield strength to fracture toughness ratio.

* * * * *